United States Patent [19]

Alexander

[11] 4,351,523

[45] Sep. 28, 1982

[54] ARM WRESTLING EXERCISER

[76] Inventor: Glenn Alexander, 3218 N. Park Dr., Flagstaff, Ariz. 86001

[21] Appl. No.: 205,723

[22] Filed: Nov. 10, 1980

[51] Int. Cl.[3] ..... A63B 23/00

[52] U.S. Cl. ..... 272/67; 272/142; 267/61 S; 267/177

[58] Field of Search ..... 272/142, 136, 67, DIG. 4, 272/137, 138, 135; 267/177, 74, 61 S

[56] References Cited

U.S. PATENT DOCUMENTS

| | | | |
|---|---|---|---|
| 964,651 | 7/1910 | Kirk | 267/177 |
| 2,261,173 | 11/1941 | Maxwell | 272/136 |
| 2,782,033 | 2/1957 | Ugartechea | 272/142 X |
| 3,815,904 | 6/1974 | Weiss | 272/136 |
| 4,026,548 | 5/1977 | Birdwell | 272/142 |
| 4,214,748 | 7/1980 | Blackmon | 272/142 |

FOREIGN PATENT DOCUMENTS

| | | | |
|---|---|---|---|
| 604340 | 3/1960 | Italy | 272/142 |
| 946495 | 1/1964 | United Kingdom | 267/61 S |

*Primary Examiner*—Richard J. Johnson

[57] ABSTRACT

An arm exercising device, including a base that clamps on a table, a plate pivoted upon the base, a set of coil springs, between the plate and base, for resisting the plate from pivoting, and a long handle attached to the plate, for being grasped by a person, while resting an elbow on the table and attempting to pivot the handle and plate against the resistance by the spring.

1 Claim, 3 Drawing Figures

FIG. 1
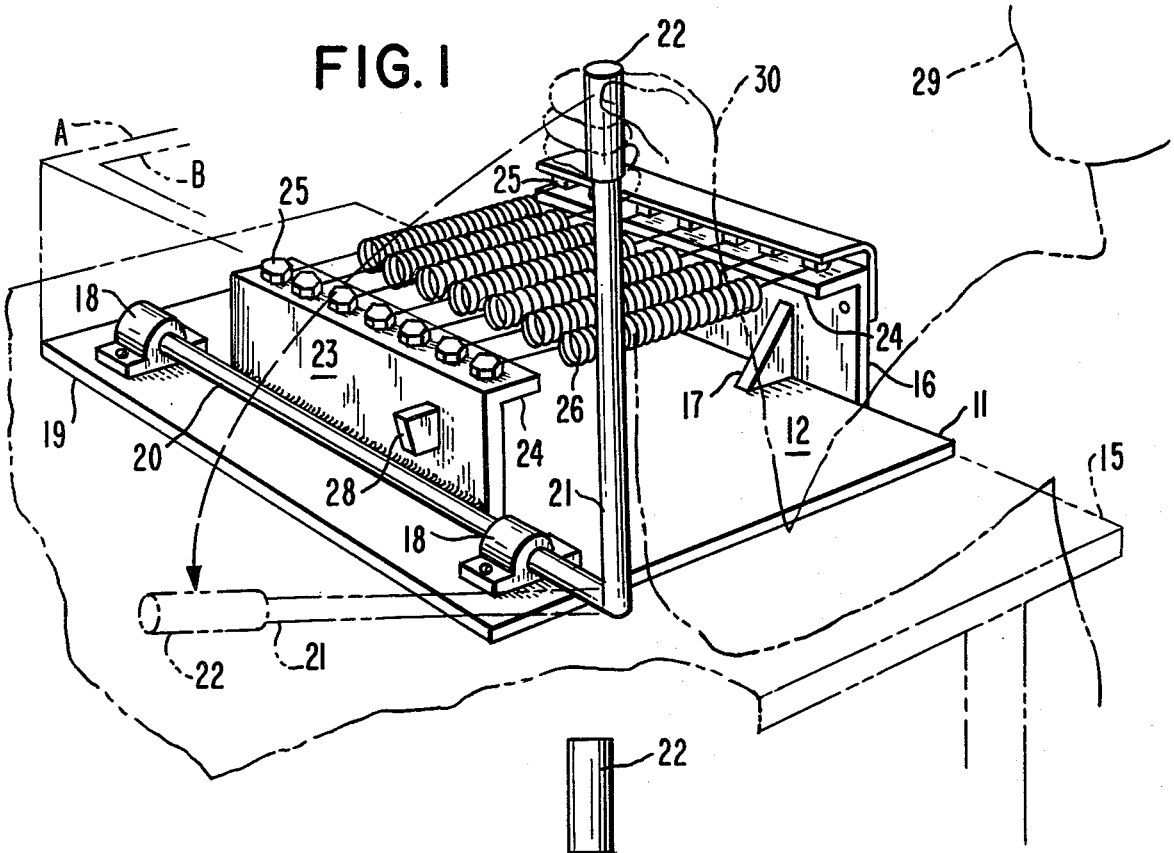
FIG. 2
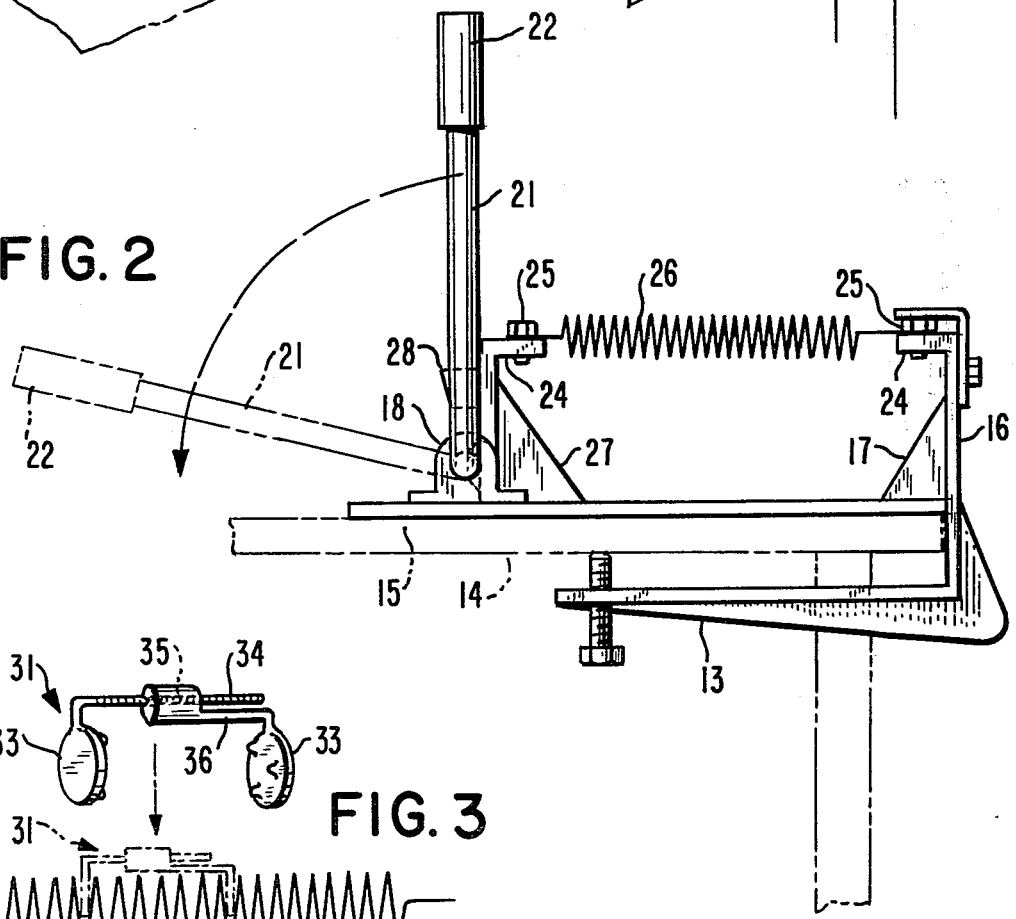
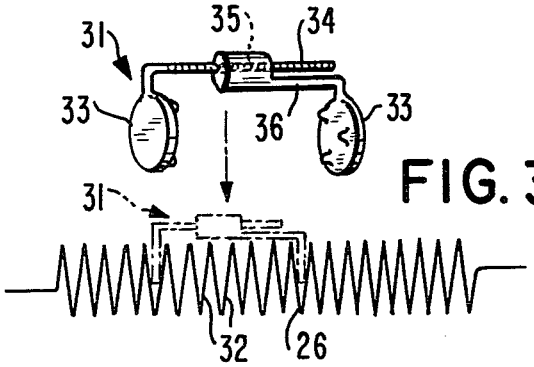
FIG. 3

ARM WRESTLING EXERCISER

This invention relates generally to exercising apparatus.

It is well known, that numerous arm exercising devices have been developed in the past; however, none of them appears to have the specific combination of advantages offered by the present invention.

A principal object of the present invention is to provide an arm wrestling exerciser, which serves to develop and strengthen the muscles of the upper arm, forearm, wrist and fingers, of either the left or right arm.

Another object is to provide an arm wrestling exerciser, which easily mounts upon a table, so that a person alongside may comfortably use the device.

Other objects of the present invention are to provide an arm wrestling exerciser, which is simple in design, inexpensive to manufacture, rugged in construction, easy to use and efficient in operation.

These, and other objects, will be readily evident, upon a study of the following specification, and the accompanying drawing, wherein:

FIG. 1 is a perspective view of the arm wrestling exerciser, shown in use, the springs being removable for tension adjustment of the device;

FIG. 2 is a side view thereof, and

FIG. 3 shows another tension adjustment means, consisting of an attachable, adjustable clip, that snaps around a selected number of the spring turns, so as to inactivate this portion of the spring.

Referring now to the drawing in greater detail, the reference numeral 10 represents an arm wrestling exerciser, according to the present invention, wherein there is a base 11, including a horizontal steel panel 12, having a clamping bracket 13, mounted at the underside of one end thereof, so as to clamp under one edge 14 of a table 15, upon which the device is placed for use.

A stationary plate 16 is mounted vertically on one end edge of the panel, and may be made integral with the bracket 13. A pair of braces 17 secures the plate 16 rigidly in place.

A pair of bearing blocks 18, near an opposite edge 19 of the panel, pivotally support a shaft 20, that is integral with a handle 21, extending at right angles thereto. An end of the handle is fitted with a handgrip 22. A pivotable plate 23 is welded along the shaft, so as to pivot therewith. Both plates 16 and 23 may be made from channel irons, so that a flange 24, along an upper edge of each, serves for a row of bolts 25 to be secured therethrough, in order that a set of tension coil springs 26 may be secured between the two rows of bolts, as shown in FIGS. 1 and 2. Alternately, hydraulic cylinders may be employed, instead of the springs.

A pair of brackets 27, secured to the pivotable plate, serve as stops for bearing against the top of the panel 12, when the handle 21 extends vertically upright, and the springs are in a relaxed position. A block 28, mounted on an opposite side of the plate 23, serves as a stop, for striking the top of the panel 12, when the handle is forced, by a person 29, to be pivoted to an extreme pivoted position.

The entire device, excepting the handle 21 and the bracket 13, may be enclosed in a box A, for protection of a user. An access door B, on top, allows access, for adjusting the springs.

In operative use, a person rests an elbow on the table top, adjacent one side of the exerciser, and grasps the handgrip with his hand 30, and then pivots the handle, so as to cause the springs to stretch, and resist the pivoting movement, so that the person's muscular strength is thus developed. By removing or adding springs 26, the spring resistance force may thus be adjusted, so as to suit a desired resistance, for a person using the exerciser.

Additional spring resistance adjustment may be made, by insertion of a clip 31 over any of the springs, in order to deactivate any selected number of spring turns 32, that are locked between a pair of toothed jaws 33, inserted into the spring. The jaws are adjustable apart, by means of a stem 34 of one being threaded, for engagement in a threaded hole 35 of a stem 36 of the other jaw.

While various changes may be made in the detail construction, it is understood that such changes will be within the spirit and scope of the present invention, as is defined by the appended claims.

What I now claim is:

1. An arm wrestling exerciser, comprising, in combination, a base, a plate pivotally supported on said base, a handle affixed on said plate for being pivotally urged by a person, and a plurality of tension coil springs between said plate and said base for resisting a pivotal force by said person; opposite ends of said springs being attached to bolts supported on said plate and said base, said springs being selectively removable or addable, for adjusting a resistance force against said person; said base including a clamping bracket on its underside for clamping to a table; and a clip insertable over any of said springs comprising a pair of toothed jaws insertable between spaced-apart turns of said spring, one said jaw being connected to a threaded stem engaged in a threaded stem of the other said jaw.

* * * * *